US009593540B2

(12) United States Patent
Millheim

(10) Patent No.: US 9,593,540 B2
(45) Date of Patent: Mar. 14, 2017

(54) SAFETY SYSTEM FOR DEEP WATER DRILLING UNITS USING A DUAL BLOW OUT PREVENTER SYSTEM

(71) Applicant: Keith K. Millheim, The Woodlands, TX (US)

(72) Inventor: Keith K. Millheim, The Woodlands, TX (US)

( * ) Notice: Subject to any disclaimer, the term of this patent is extended or adjusted under 35 U.S.C. 154(b) by 0 days.

(21) Appl. No.: 13/895,012

(22) Filed: May 15, 2013

(65) Prior Publication Data

US 2013/0248198 A1 Sep. 26, 2013

Related U.S. Application Data

(63) Continuation of application No. 13/100,124, filed on May 3, 2011, now abandoned.

(60) Provisional application No. 61/330,620, filed on May 3, 2010.

(51) Int. Cl.
*E21B 17/01* (2006.01)
*E21B 33/064* (2006.01)

(52) U.S. Cl.
CPC ..... *E21B 17/012* (2013.01); *E21B 33/064* (2013.01)

(58) Field of Classification Search
CPC ..... E21B 17/01; E21B 33/035; E21B 33/06; E21B 43/0122; E21B 34/04; E21B 19/004; E21B 33/03; E21B 41/0007; B63B 21/508
USPC ..... 166/356, 367, 85.4, 344, 350, 351, 352, 166/359
See application file for complete search history.

(56) References Cited

U.S. PATENT DOCUMENTS

| | | | | |
|---|---|---|---|---|
| 2,854,215 | A | 9/1958 | Cox et al. | |
| 3,202,216 | A * | 8/1965 | Watts | B63C 11/38 166/356 |
| 3,211,223 | A * | 10/1965 | Hoch | 166/356 |
| 3,466,880 | A | 9/1969 | Elliott | |
| 3,556,208 | A | 1/1971 | Dean | |
| 3,964,543 | A | 6/1976 | Rodgers | |
| 4,712,620 | A | 12/1987 | Lim et al. | |
| 5,014,781 | A | 5/1991 | Smith | |
| 5,657,823 | A | 8/1997 | Kogure et al. | |
| 5,676,209 | A * | 10/1997 | Reynolds | 166/345 |
| 5,873,416 | A * | 2/1999 | Horton, III | 166/344 |
| 2006/0042800 | A1 | 3/2006 | Millheim et al. | |
| 2006/0254776 | A1 | 11/2006 | Williams | |
| 2007/0261856 | A1* | 11/2007 | Deul | E21B 17/01 166/367 |
| 2011/0247827 | A1 | 10/2011 | Humphreys | |
| 2013/0014688 | A1* | 1/2013 | Yemington | 114/264 |

* cited by examiner

*Primary Examiner* — James G Sayre
(74) *Attorney, Agent, or Firm* — Andrus Intellectual Property Law, LLP

(57) ABSTRACT

A dual-BOP or multi-BOP self-standing riser configuration is disclosed, including at least a riser or another similarly fixed tubular structure disposed in communication with an associated drilling vessel and a subsurface well. The system supplements the traditional mud-line level BOP with one or more additional near-surface BOPs, which are tensioned using an adjustable buoyancy chamber rather than by means of a vessel-born tensioning device.

13 Claims, 6 Drawing Sheets

SAFETY SYSTEM FOR DEEP WATER DRILLING UNITS USING A DUAL BLOW OUT PREVENTER SYSTEM

BACKGROUND

When drilling in deep water (e.g., greater than 350 ft. water depth), a frequent practice is to employ a mobile offshore drilling unit (MODU). A typical MODU can be either a semi-submersible drilling unit or a drill ship. The common practice for conducting operations is to run a subsea blow out preventer (BOP), which uses an associated or contained apparatus called a ram to (i) close around various pipe diameters (pipe rams); (ii) fully close the well (blind rams); (iii) close around most pipe diameters (annular rams); or (iv) shear a pipe (shear ram). Such BOP system assemblies are usually either hydraulically and/or electrically actuated, with various controls disposed on the MODU, or even an acoustical activation that can be remotely activated away from the rig.

These BOPS are installed on a riser and positioned on the wellhead at or near the mud line. The riser is generally between 16-inches in diameter to 22-inches in diameter. The riser will usually also carry the control and activation lines from the MODU to the BOPs. The riser is typically tensioned and held in place by riser tensioners located on the MODU. Such systems have been used by MODUs for years in water depths over 10,000 ft.

Other systems, for example, as disclosed in U.S. Pat. No. 7,458,425 to Millheim et al. entitled *System & Method of installing & Maintaining an Offshore Exploration & Production System Having an Adjustable Buoyancy Chamber* show an adjustable buoyancy chamber disposed in communication with the riser underwater, so that riser tension can be varied to either raise the riser and/or a wellhead above the surface (e.g., for intervention) or lower the riser and wellhead (e.g., for safety during a storm, etc.) either with or without a drilling ship.

A common misconception associated with this configuration is that the riser/BOP assembly is sufficient to establish and maintain control of the well by closing it off in the event of a fluid incursion (whether oil, gas and/or water), and to maintain the integrity of the well by circulating incurred fluids in water in order to regain control of the well in an emergency.

However, a recent drilling accident in the Gulf of Mexico demonstrates that the traditional riser/BOP configuration can fail when hydrocarbons (oil and gas) are uncontrollably released from a well, thereby causing extensive environmental harm and loss of human life. Needless to say, the MODU used in the Gulf of Mexico incident was also destroyed. This event demonstrates that the industry's assumption about the existing BOP riser system, which was previously thought safe and nearly fool-proof, is incorrect and should be challenged.

SUMMARY OF THE INVENTION

A self-standing riser system is provided, said system including at least a subsurface well disposed in communication with a first BOP; a riser assembly disposed in communication with said subsurface well; an adjustable buoyancy chamber disposed in communication with said riser assembly; and a second BOP disposed in communication with said riser assembly located above said adjustable buoyancy chamber and wherein the second BOP is configured to enable quick decoupling from a surface vessel or MODU such that no portion of the riser assembly extends beneath the surface vessel or the MODU when the surface vessel or MODU is moved from the subsurface well.

DETAILED DESCRIPTION OF SEVERAL EXAMPLE EMBODIMENTS

Broadly stated, this disclosure presents a newly designed BOP riser system in which disadvantages of the prior art are overcome.

Figure 1:
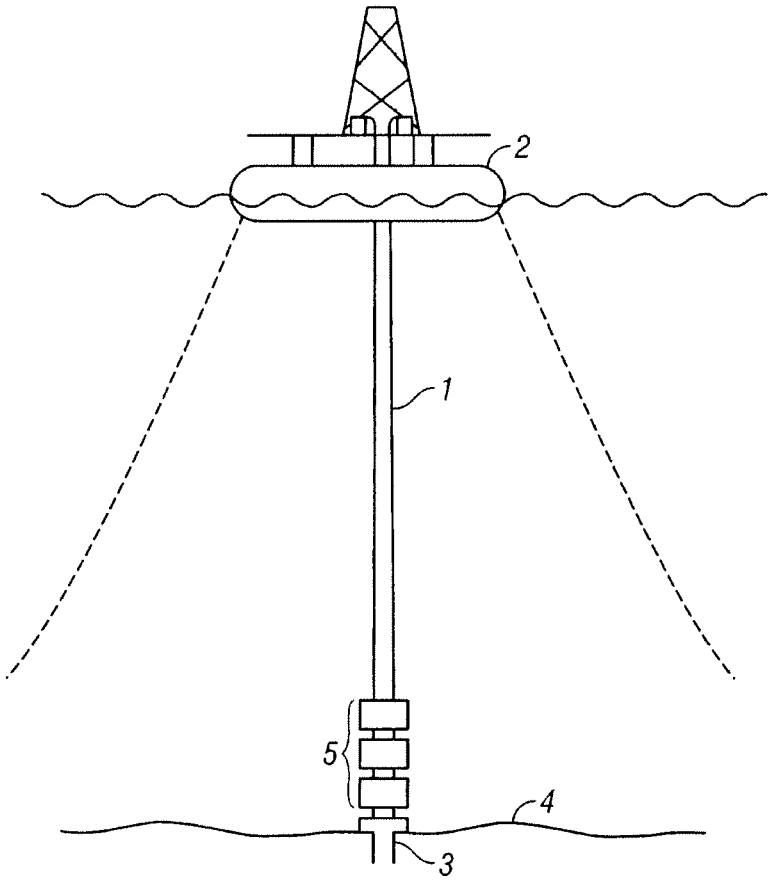
FIG. 1 PRIOR ART
FIG. 1 depicts a combined riser and BOP configuration according to the prior art.

Referring to FIG. 1, a prior art BOP riser system is depicted, comprising a riser 1 suspended from a drilling vessel 2, disposed in communication with a subsurface well 3. Just above the mud line 4, a BOP stack 5 is installed.

As suggested above, this system has many drawbacks. For example, the subsurface well can not be easily controlled from the surface, especially in deep waters where remote-operated vehicles are required. Also, the BOP must be cooled prior to initiating shutdown of the well because of heat associate with the near-well drilling activity. Moreover, the well can not be quickly closed in during an emergency in the event of dangerous subsurface conditions. Finally, the drill ship or MODU associated with the site must be quickly decoupled from the riser in order to escape a pending disaster.

Figure 2:
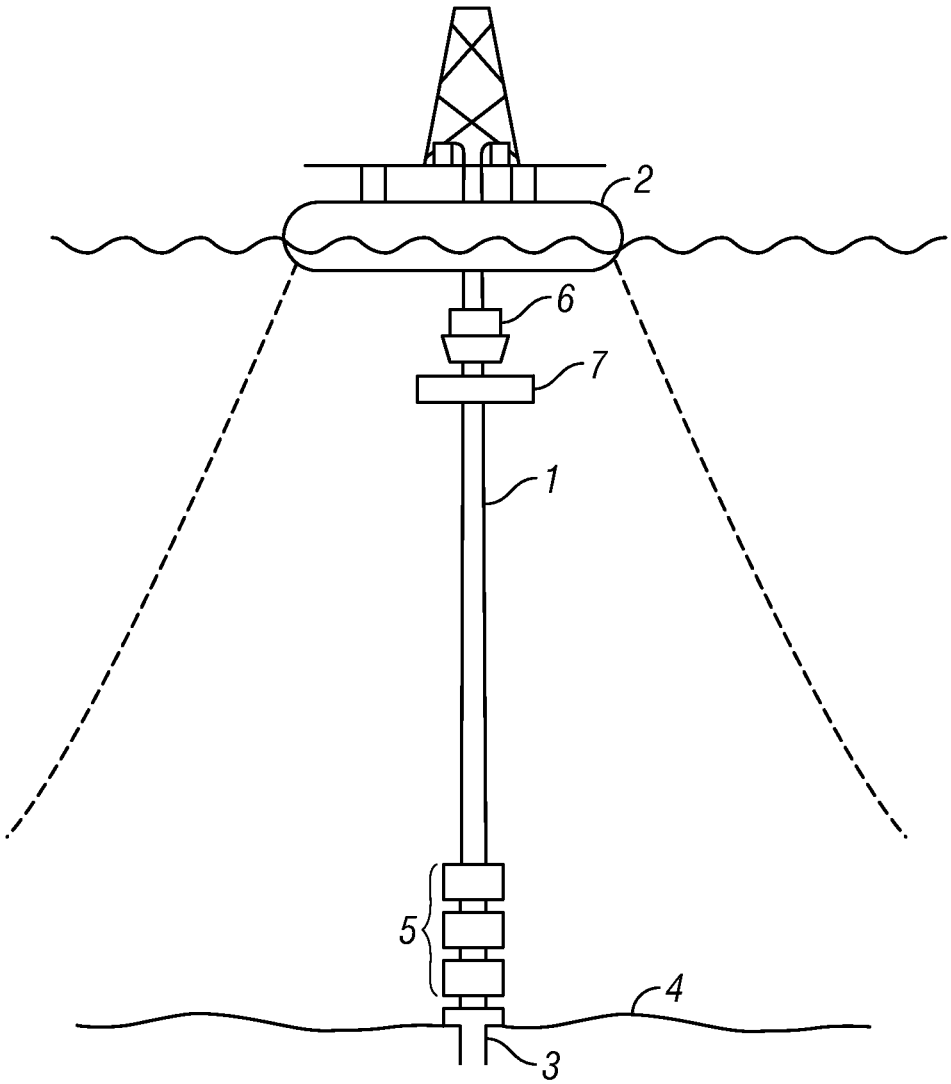
FIG. 2 depicts an example embodiment of the present invention, including one or more near-surface BOPs tensioned into place by an associated adjustable buoyancy chamber.

As seen in FIG. 2, the present invention improves the prior art by disposing a riser 1 (noting that the term riser is used flexibly in this context, and is broad enough to encompass the wide variety of risers, stacks, and other concentric or fixed tubular structures used during drilling) in communication with an associated drilling vessel 2 and a subsurface well 3 by supplementing at the mud level 4 a BOP stack 5 with one or more additional BOPs 6, tensioned by means of an adjustable buoyancy chamber 7 rather than by means of a vessel-born tensioner (chains, lifts, etc.).

Figure 3:
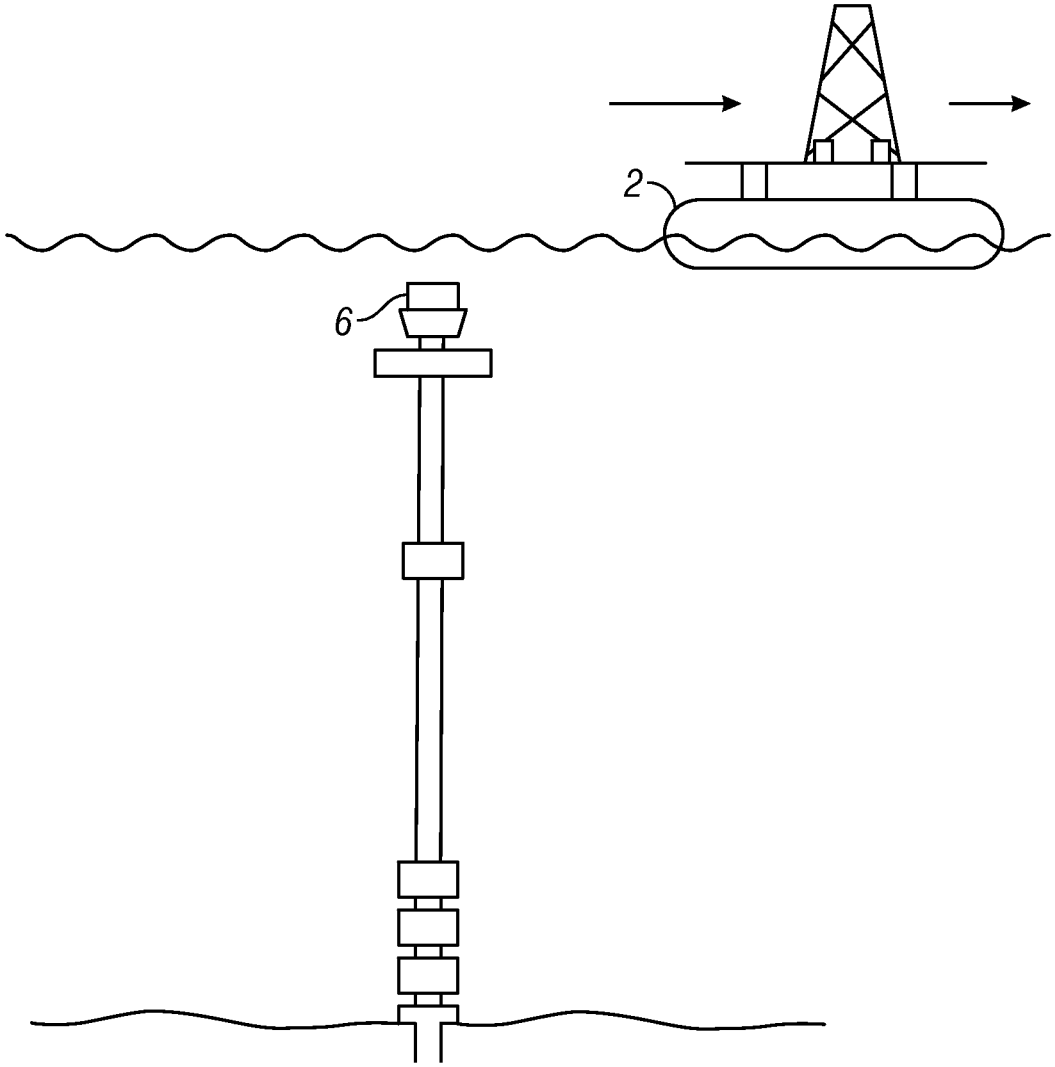
FIG. 3 depicts the example embodiment of FIG. 2, wherein a drilling ship or MODU is disconnected from the riser and moved away from the well site.

This self-standing riser BOP configuration has many advantages. For example, as seen in FIG. 3, an associated drilling vessel 2 or MODU can be quickly decoupled from the wellhead (rather than the riser) and removed from the scene or location of a safety event.

Figure 4:
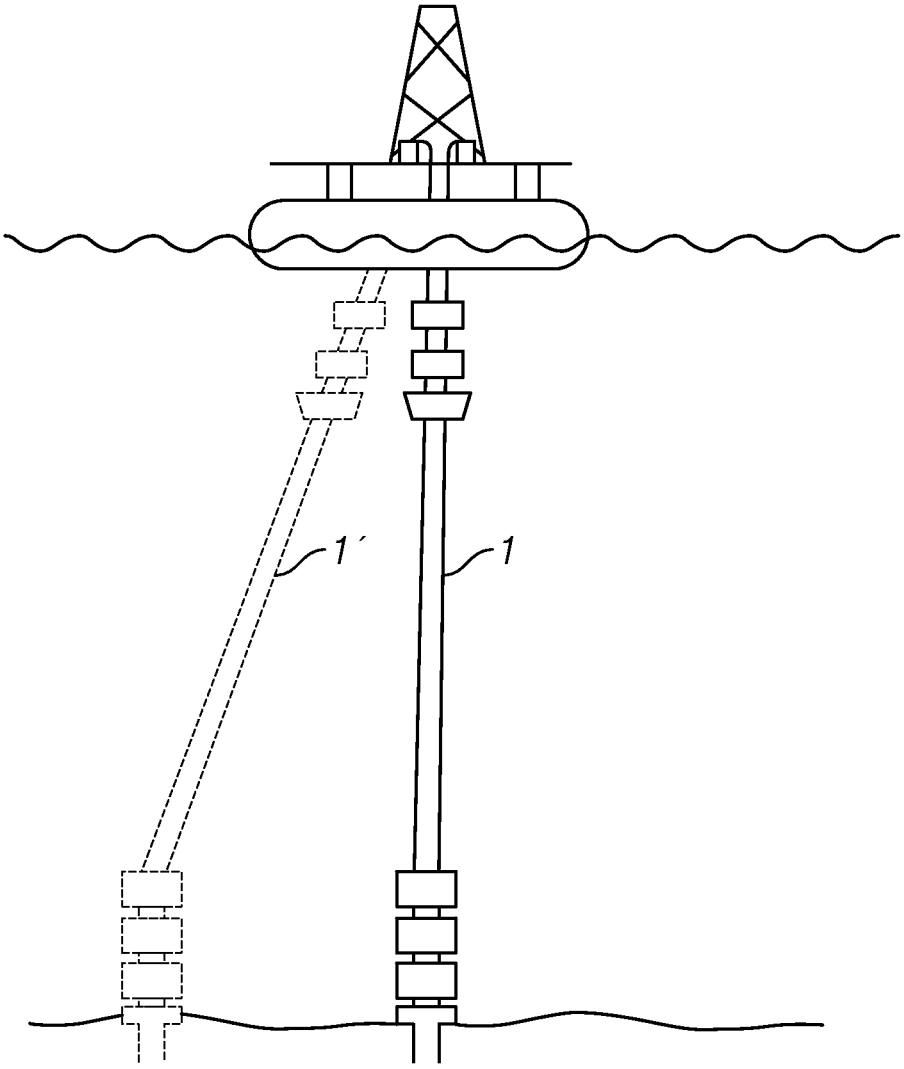
FIG. 4 depicts the example embodiment of FIG. 2 as disposed in either a fixed or dynamically positioned configuration.

Upper BOP(s) 6 can be quickly closed using a contained ram or the like, without the delay associated with an extensive cool-down period. The ram can be actuated either electronically or acoustically, etc., or even manually by divers just beneath the surface rather than cumbersome ROVs operating in deep water. This configuration is equally effective with both fixed-anchor systems (as in FIG. 1) and dynamically positioned riser configurations (see FIGS. 4 at 1 and 1'), and a drilling vessel 2 can moved be out and replaced with successive vessels appropriate for different tasks (testing, separation, etc.) if desired.

The upper BOP(s) 6 can be used as both a redundant operating system and a redundant safety system. For example, in the case of operations, a neighboring rig can control wellbore fluids at multiple locations (e.g., the mud line and near the surface). If the mud-level BOP(s) should fail, operations can continue by controlling the near-surface BOP(s).

For safety, a number of BOP(s) disposed at different locations along the riser (again, for example, near the mud line and near the surface) can be equipped with rams or other shut-offs in order to more easily and quickly control the well during an emergency.

The buoyancy chamber(s) 7 support (either fully or partially) the weight of both the riser and the near-surface BOPs in the event the drilling ship or MODU 2 must disconnect and move away from the well. In this manner, the system maintains the integrity of the riser system until the MODU can return or be replaced with another suitable vessel, which is then reconnected to the riser for continuing operations.

Another advantage of the instant system is the fact that the near-surface BOP(s) 6 can also be located in very shallow waters, where in the event of a component failure or the like, a diver can deploy to repair the BOP(s). This is not possible in the case of most deep-water BOPs 5.

In fact, recent events associated with a deepwater BOP failure show that sole dependency on ROVs to repair or reactivate the deepwater BOPs 5 is, in some situations, ineffective, whereas in the presently claimed configuration BOP(s) 6 would still be accessible, whether by ROVs, divers or diver-assisted vessels.

Figure 5:
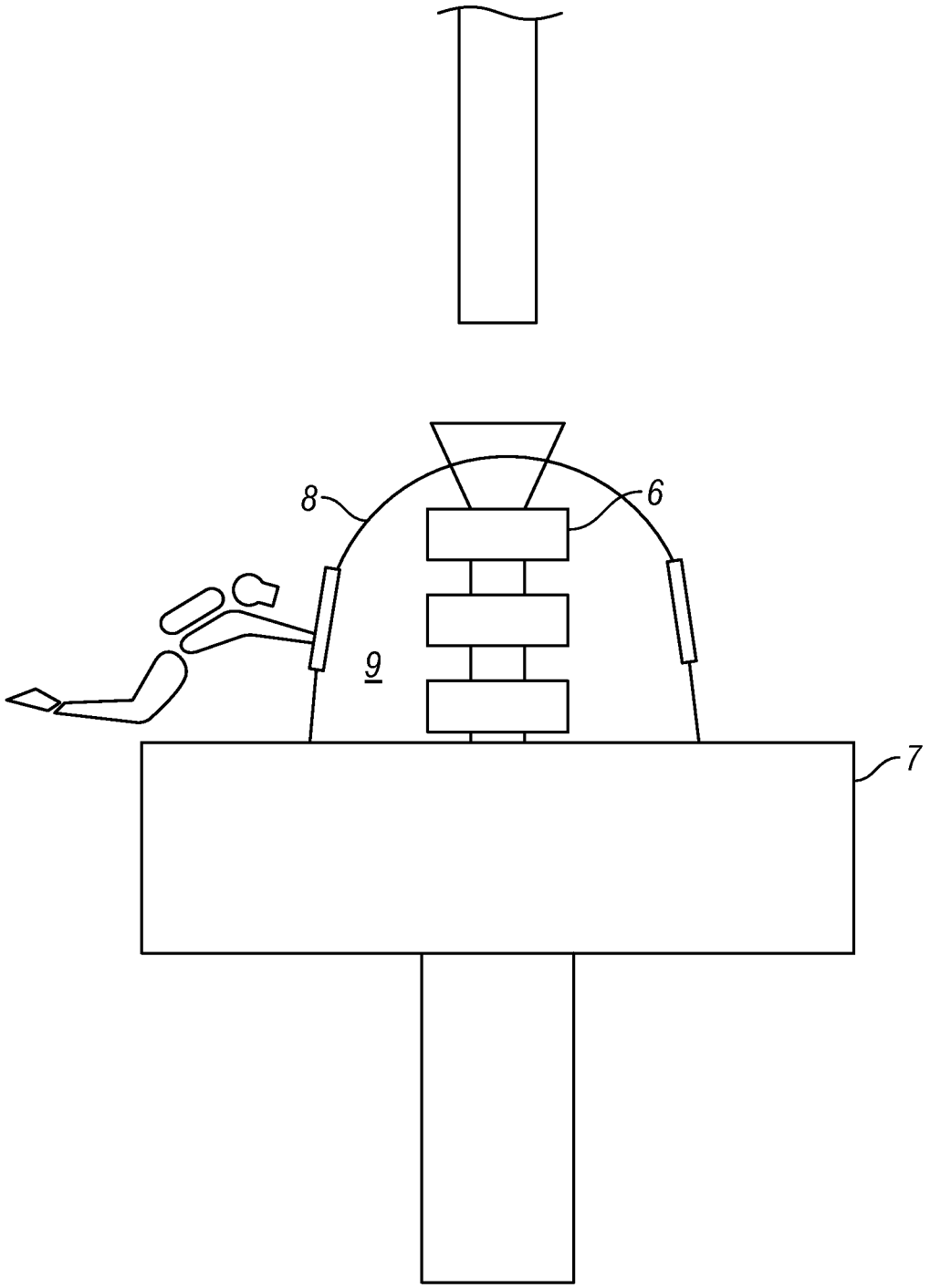
FIG. 5 depicts a diver-accessible, water-proofed chamber disposed in communication with one or more near-surface BOPs.

A functional improvement to the workability of near-surface BOP(s) 6 for repair would be the addition of a waterproofed outer hull 8 in which divers can enter the chamber, pump out or otherwise evacuate the water and work in a more favorable environment 9 to repair or reactivate the BOP(s) (see FIG. 5).

This configuration offers other advantages once the riser system has been connected. For example, there are frequently minimal time windows during which a BOP assembly will require service or movement. By virtue of the disclosed near-surface BOP arrangements, the system can be quickly closed for service or movement and downtime due to the presence of loop currents (or other fast-moving currents) otherwise needed to connect or re-connect the riser system will be minimal, thereby saving millions of dollars. In contrast, a MODU cannot perform these operations with the riser under such circumstances.

Figure 6:
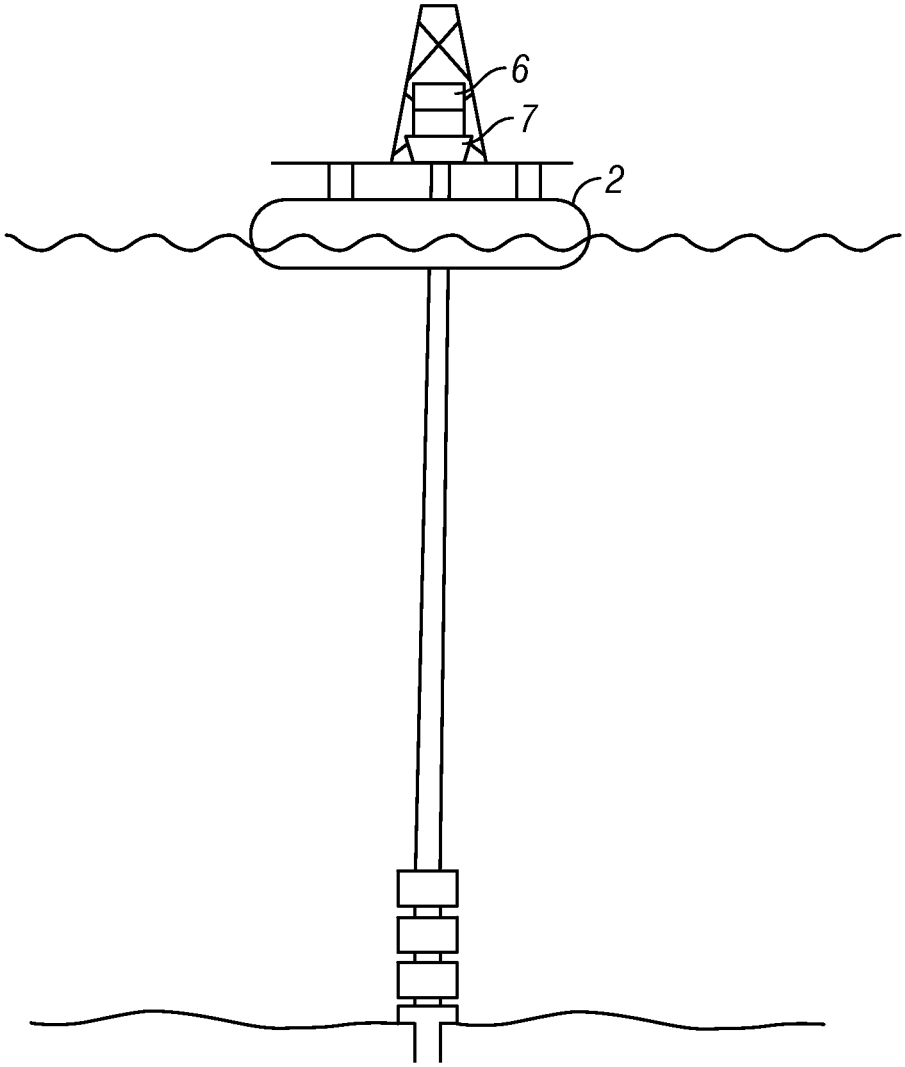
FIG. 6 depicts a further example embodiment in which the adjustable buoyancy chamber has been used to lift the near-surface BOPs to the water surface for further handling by a MODU or drilling ship.

The dual (or multi) BOP configuration used in combination with an adjustable buoyancy chamber can be used to tension the riser system near the surface so that it can be joined in a conventional manner by a MODU (see FIG. 4), and even lift the upper BOPs to the water level or higher for connection to a drilling ship (see FIG. 6).

The foregoing specification is provided for illustrative purposes only, and is not intended to describe all possible aspects of the present invention. Moreover, while the invention has been shown and described in detail with respect to several exemplary embodiments, those of ordinary skill in the pertinent arts will appreciate that minor changes to the description, and various other modifications, omissions and additions may also be made without departing from either the spirit or scope thereof.

The invention claimed is:

1. A self-standing riser system, said system comprising:

a first BOP which in use is in communication with a subsurface well;

a riser assembly extending between a movable surface vessel or MODU and said subsurface well, and disposed, in use, in communication with said first BOP and said subsurface well;

an adjustable buoyancy chamber disposed in communication with said riser assembly; and a second BOP disposed in communication with said riser assembly and located above said adjustable buoyancy chamber and wherein the second BOP is configured to enable quick decoupling from the surface vessel or the MODU such that no portion of the riser assembly extends beneath the surface vessel or the MODU when the surface vessel or MODU is moved from the subsurface well, wherein the second BOP is located within a hull having an upper surface disposed around the second BOP, and a lower surface supported on the adjustable buoyancy chamber to define a hull chamber configured to enable repair and reactivation of the second BOP.

2. The system of claim 1, wherein said second BOP is also disposed in communication with a surface vessel.

3. The system of claim 1, wherein said first BOP further comprises a plurality of BOPs.

4. The system of claim 1, wherein said second BOP further comprises a plurality of BOPs.

5. The system of claim 1, wherein each of said first BOP and said second BOP further comprise a plurality of BOPs.

6. The system of claim 1, further comprising a waterproof chamber disposed around said second BOP.

7. The system of claim 1, wherein said adjustable buoyancy chamber is used to tension said riser assembly to a depth at which a human diver can service or replace said second BOP.

8. The system of claim 1, wherein said adjustable buoyancy chamber is used to tension said riser assembly such that said second BOP is lifted to approximately the same height as the surface of a surrounding body of water.

9. The system of claim 1, wherein said riser system is restrained in place using a fixed anchoring system.

10. The system of claim 1, wherein said riser system is positioned relative to said wellhead using dynamic positioning.

11. The system of claim 1, wherein the second BOP operates in use as a redundant operating system and a redundant safety system.

12. The system of claim 1, wherein the second BOP is disposed at a near surface location.

13. The system of claim 1, wherein the hull chamber forms an evacuable closed environment, and the upper surface of the hull provides access to the hull chamber.

* * * * *